US006152298A

United States Patent [19]

Dods

[11] Patent Number: 6,152,298

[45] Date of Patent: Nov. 28, 2000

[54] MODEL AND SHAPED CARD PACKAGING SYSTEM AND METHOD FOR SAME

[75] Inventor: Robert E. Dods, Burr Ridge, Ill.

[73] Assignee: Racing Champions, Inc., Glen Ellyn, Ill.

[21] Appl. No.: 09/294,420

[22] Filed: Apr. 19, 1999

[51] Int. Cl.[7] ..... B65D 75/54

[52] U.S. Cl. ..... 206/335; 206/457; 206/459.5; 206/471

[58] Field of Search ..... 206/232, 335, 206/457, 459.5, 461, 470, 471; 53/471, 472; 446/73, 77

[56] References Cited

U.S. PATENT DOCUMENTS 4,056,190 11/1977 Dix ..... 206/457
5,845,778 12/1998 Hickey, Jr. ..... 206/461

*Primary Examiner*—Jim Foster
*Attorney, Agent, or Firm*—Reinhart, Boerner, Van Deuren, Norris & Rieselbach, s.c.

[57] ABSTRACT

This invention generally relates to display packaging of trading cards, alone or in combination with models. In particular, this invention relates to the packaging of trading cards in the shape of entertainment figures and the combination of such cards with model vehicles and display stands.

21 Claims, 3 Drawing Sheets

MODEL AND SHAPED CARD PACKAGING SYSTEM AND METHOD FOR SAME

BACKGROUND OF THE INVENTION

This invention generally relates to display packaging of trading cards, alone or in combination with models. In particular, this invention relates to the packaging of trading cards in the shape of entertainment figures and the combination of such cards with model vehicles and display stands.

Traditionally, trading cards relating to sports figures or other popular entertainment figures or objects have been sold individually packaged, marketed and collected. Similarly, models of vehicles, other objects or people have been marketed and collected. In recent years, trading cards have been combined with model vehicles to create a number of collectible combination items. However, interest in such combinations has fallen due to the traditional appearance of the combinations. Trading cards have retained a historic rectangular shape, and the models are limited to race cars. Unfortunately, many collectors view this traditional appearance as antiquated and desire alternative combinations or the same combinations with an alternative appearance. Additionally, collectors are regularly seeking new collectable markets which have not been exploited by the traditional combinations.

In an attempt to arouse interest in trading card combinations, improvements of the combination included a display stand to hold the trading card and the model thereby creating a new combination. Despite this, such a stand is still limited in that it displays the traditional rectangular trading card that many collectors are seeking to avoid.

One approach used to display the combination to collectors is a package system displaying the model and stand together in a traditional blister pack attached to a paperboard sheet. The paperboard sheet contains the trading card as an unitary part thereof. To remove the trading card, consumers have to cut a rectangular shaped portion from the sheet. A problem with this package system is the model and the stand would have to be removed from the package before combining them with the trading card. The disadvantage presented by this package system is that a collector cannot readily visualize the combination as it appears after opening. Without visualizing the appearance of the combination, a collector cannot readily determine the combinations appearance and potential value. An additional aesthetic disadvantage to this type of package system is that wear and tear is inflicted on the package and trading card during shipping. Functionally, because the trading card is not enclosed in the blister pack and is exposed to wear and tear, the card becomes virtually worthless to a collector attempting to obtain a card in perfect condition.

In addition to the combination having the aforementioned aesthetic and functional deficiencies, the package system of the prior art also fails to provide an effective means for restraining the contents of the package in a fixed position when handled. In many instances, the model and display stand shift in the package to display an unattractive combination thereby deterring potential collectors from purchasing the combination.

In summary, there are a number of drawbacks and problems to the traditional design and packaging of trading cards and combinations of trading cards with other objects such as models and display stands. Specifically, package systems that display these combinations have problems and drawbacks with their aesthetic design, appearance and functionality. There is a need for alternative trading card designs when placed in combination with a model and a display stand and a package system to fully realize the benefits provided by such a trading card or combination thereof.

OBJECTS OF THE INVENTION

It is an object of this invention to overcome the problems and shortcomings of the prior art, including those outlined above.

It is an object of this invention to provide an improved packaging system to securely display a combination including a trading card in the shape of an entertainment figure and a model.

Yet it is another object of this invention to provide an improved packaging system to securely display in a neat and attractive manner a model in combination with a trading card in the shape of an entertainment figure.

Still it is another object of this invention to provide an improved packaging system to securely display a model vehicle, object or person in combination with a die-cut trading card, the die-cut trading card bearing the shape of an entertainment figure, such a die-cut trading card bearing a similar graphic, pictorial or textual design with the model to present a neat, attractive combination.

Yet it is another object of this invention to provide an improved packaging system to securely display a model vehicle, object or person in combination with a shaped trading card and a display stand, where the display stand bears a similar graphic, pictorial or textual design with the model and the shaped card, and the display stand securely supports such model and shaped card to present a neat, attractive combination.

Another object of this invention is to provide a novel packaging system to securely display in a fixed position a model vehicle, object or person in combination with a trading card in the shape of an entertainment figure and a display stand, where the display stand bears a similar graphic, pictorial or textual design with the model and trading card, thereby presenting a neat, attractive combination.

It is an object of this invention to provide a novel method to package a combination including a trading card and model so that the trading card appears in a raised, three-dimensional appearance.

It is yet another object of this invention to provide a method of using a trading card in combination with a model to give the combination a three-dimensional appearance.

These and other important combinations and methods will be apparent to one of ordinary skill in the art from the following descriptions of the present invention.

SUMMARY OF THE INVENTION

This invention is a package system to display a combination including at least a trading card and a model in a secure, fixed position, and a method of packaging the combination so that the trading card or combination appears in a raised position giving the illusion of a three-dimensional figure. The invention overcomes certain well-known problems and deficiencies, including those outlined above.

In part, this invention is a package system for displaying a trading card and model combination. The package system includes at least one model and a card, the card having a front and rear face and in the shape of a figure related to an entertainment field including sports, movies, and television. The card may be cut in the shape of an entertainment figure by numerous methods including the use of a die, a pair of scissors, heat, light or press. The entertainment figure may be in the form of a human or object, such as a wrestler or a racing car, respectively. The package system can further include a package enclosing the combination, the package having a substantially rigid sheet and a shell. The combination rests in the interior of the shell, lying between the shell and the sheet. The shell can then be attached to the sheet, thereby packaging the combination.

In preferred embodiments, the model typically used is a miniature vehicle, the miniature vehicle being a replica of a sports car, racing car, personal truck, industrial truck or any other type vehicle. The model and the card in the shape of an entertainment figure can bear similar graphics, text or pictorials. Additionally, factual information regarding the figure typically can be printed on the rear face of the card. To display the combination in an aesthetically pleasing manner, the shell can be molded in substantially the same shape as the model and the card. However, it is apparent to one of ordinary skill in the art that the shell may be shaped in a number of forms to enclose the model and the card. The shell may be shaped with substantially parallel top and bottom walls and substantially parallel side walls with a depth large enough to enclose the card and the model. Additionally, another common embodiment of the invention has the shell situated coplanar with the front face of the sheet and attached to a plastic backing situated coplanar with the rear face of the sheet forming a laminate structure with the card and the model enclosed therein. Additionally, the shell can be made from transparent plastic although any type of rigid, semi-rigid or flexible transparent material may be used.

In a further embodiment of this invention, the package system can include a plastic insert, although other materials used to fill a void may be used including paper, cardboard, paperboard and composites. In such an embodiment, the insert can be positioned between the sheet and the card within the shell to retain the card and model in a fixed and secure position. Other embodiments have the insert being contiguous with the sheet thereby creating an unitary structure or have multiple inserts. Additionally, at least one model support engages the model or model and card, or both, to secure the contents of the package system.

In part, this invention can be a package system for displaying a combination including a display stand, at least one model and a card. The package system further includes a plastic shell and a sheet. The package system is similar to the package system described above but for the addition of a display stand being positioned adjacent to the model and the card within the shell of the package system. The card can be coupled with the stand, however, it is apparent to one skilled in the art that the card may be placed in other positions adjacent to the stand although not coupled with the stand. Additionally, the stand may include a platform where the model may be removably positioned. When the model is placed atop of the platform, a combination is formed with the stand and the card, the combination being visually apparent to a consumer. The model, the card and the stand can bear similar graphics, text or pictorials.

In part, this invention is a package system for restraining a combination including a model, a trading card and a display stand within a package, the package including a transparent plastic shell and a substantially rigid sheet. The combination can be restrained from vertical or horizontal movement by at least one model support engaging the model and the shell. Although this is one embodiment, one skilled in the art could imagine multiple supports throughout the shell to maintain the contents in a fixed and secure position. The support can be made from a plastic material, however, it is apparent to one skilled in the art that any material to fill a void may be used including paper, cardboard, paperboard, and composites.

In a highly preferred embodiment of this invention, the package system includes an insert, the insert can be positioned between the card and sheet. The insert may engage the card to secure the card and the stand in the fixed position. Although this embodiment is preferred, other embodiments may have the insert positioned against the stand or the stand and card combination. Additionally, the insert can be made from plastic although any material to fill a void may be used including paper, cardboard, paperboard, and composites.

In part, this invention is a method of using a package system to elevate a trading card, or trading card combination with at least one model vehicle from the sheet. The combination may include additional items such as a display stand. The combination can be placed within a plastic shell and can be enclosed by a substantially rigid paperboard sheet. In one embodiment, the model can be placed atop of a stand that can be coupled to the card. The card may be substantially parallel to the sheet, although other embodiments are available. At least one insert can then be positioned between the sheet and the card, thereby elevating the card from the sheet. The elevation and depth creates a three dimensional appearance, making it more attractive to consumers. To enhance the three-dimensional appearance, the perimeter of the shell surrounding the card forms a wall substantially perpendicular to the sheet. The wall provides depth and structure to the package system to make it appear as if the card projects outwardly from the sheet.

Although in the preferred embodiment, the insert is a separate and single structure within the package system, in many cases it would be apparent to one of ordinary skill in the art to imagine multiple inserts or an insert contiguous with the sheet. Additionally, it is imaginable to one skilled in the art that the sheet be made from cardboard, plastic or any other substantially rigid material. The shell can typically be made from semi-rigid, transparent plastic, although rigid and flexible transparent material may be used.

In another embodiment of this invention, at least one support may be placed in the shell to restrain and fix the contents of the shell so that the contents of the package system maintain a position aesthetically pleasing to the eye. The support can engage the model and maintain the model in a fixed position adjacent to the shell. Furthermore, the support can elevate the model from the card to give the model an aesthetically pleasing appearance and three dimensional character. Although this is a preferred embodiment of the present invention, it is apparent to one skilled in the art to position at least one support in alternative locations within the package system including adjacent the card, the stand, the model, or any combination thereof.

The package system of this invention allows the benefits of displaying a trading card and model in combination to be more fully realized. The trading card in the shape of an entertainment figure is aesthetically pleasing in appearance and provides a novel collectible item when placed in combination with a model. Furthermore, the shell of the package provides a sleek, dynamic appearance that previously was unavailable when molded in the shape of the card and model. Additionally, when the shaped trading card and model are combined with a display stand, the combination may be displayed as it appears after removed from the package system. Such a benefit allows a consumer to know the potential value of the combination and how the combination appears when opened and assembled.

Again, an additional benefit afforded by this invention is that the trading card and model combination, or the trading card, model and display stand combination, can be maintained in a fixed position while packaged. At least one model support and at least one insert secure the combination within the package system from movement. Such a benefit allows the packages to be shipped without the worry of the contents shifting and becoming aesthetically unappealing. By securing the contents of the package, consumers are able to view a neatly positioned and aesthetically pleasing combination.

This invention also allows the trading card and model to be displayed in an elevated position. By elevating the trading card and model from the sheet, the card and model are presented in a three dimensional manner. Again, this packaging method creates a more visually appealing package system, while maintaining the contents in a secured position.

DESCRIPTION OF PREFERRED EMBODIMENTS

Figure 1:
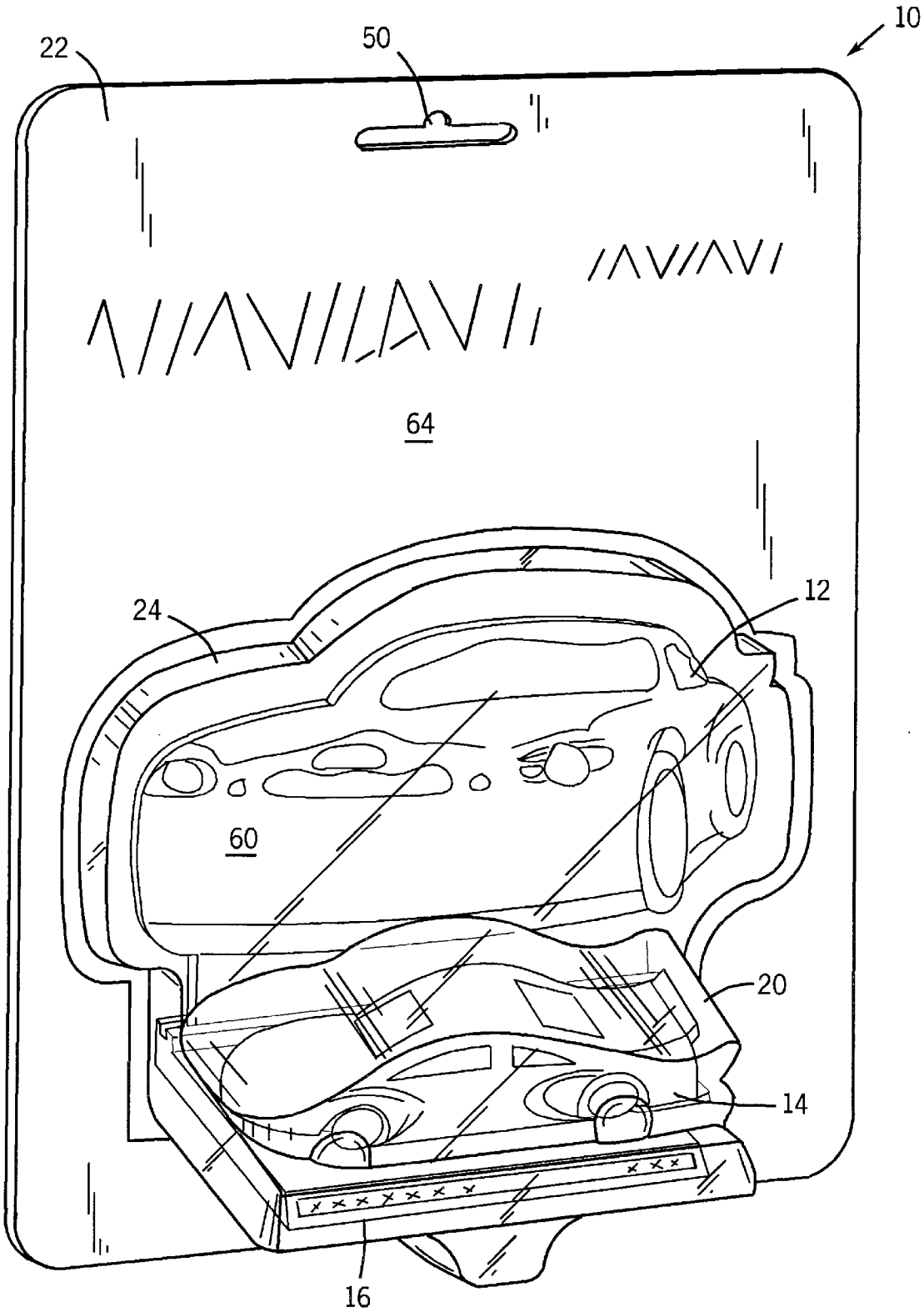
FIG. 1 is an isometric view of the front side of a package system in accordance with the present invention, the package system including a sheet, a shaped trading card, a model of a miniature vehicle, a display stand, a model support and a molded shell.

Referring particularly to FIG. 1, a package system 10 constructed in accordance with this invention includes a substantially rigid sheet 22 normally made from paper board but which could be made from most any material. A slot 50 is provided near the top of the sheet 22 to enable the sheet 22 to be hung on a conventional display hook or the like. Advertising and product information may be printed on the face 64 of the sheet 22.

Figure 2:
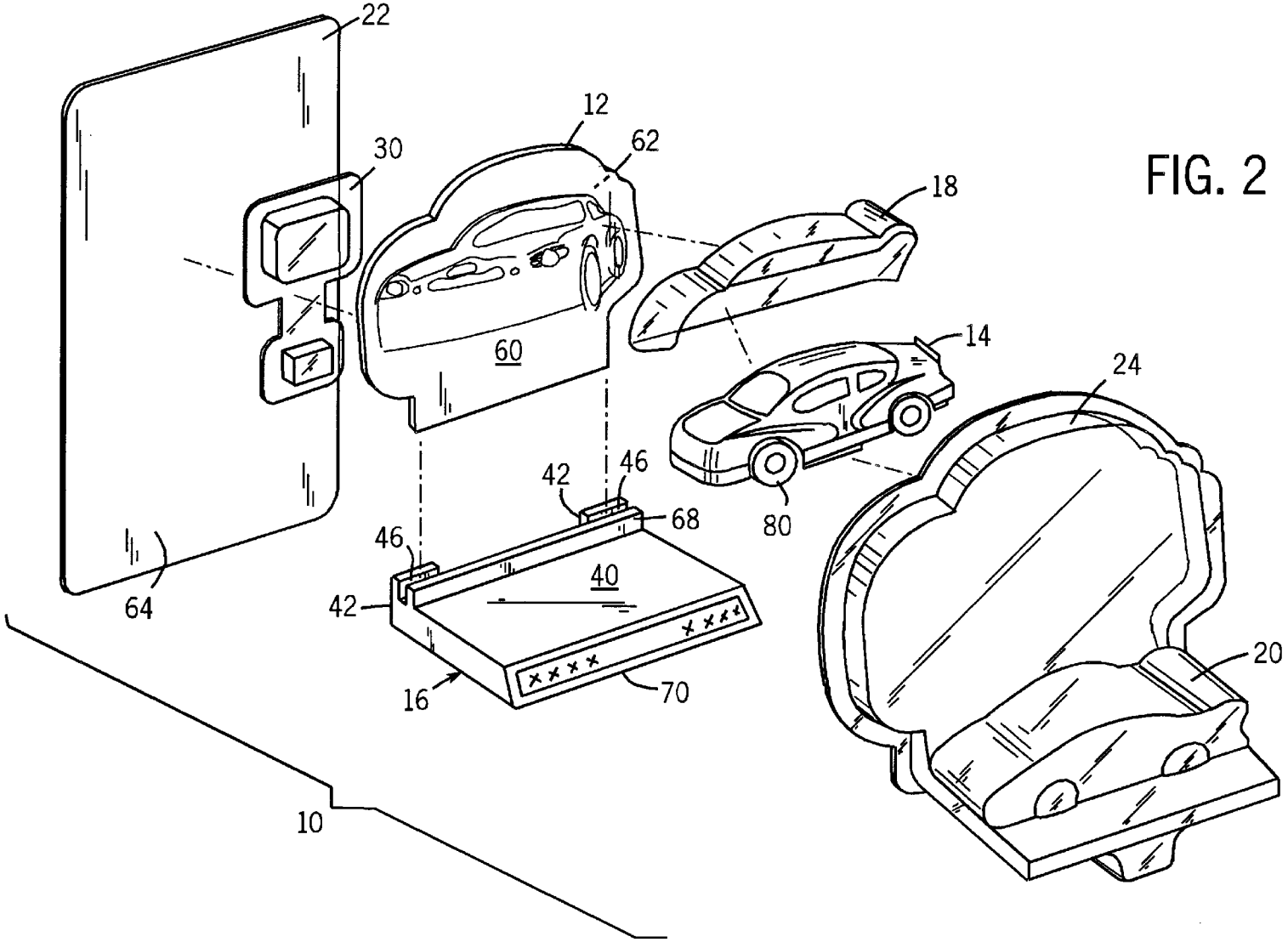
FIG. 2 is an exploded isometric view of the package system in accordance with the present invention including the sheet, an insert, the shaped trading card, the model support, the model of a miniature vehicle, the display stand, and the molded shell.
Figure 3:
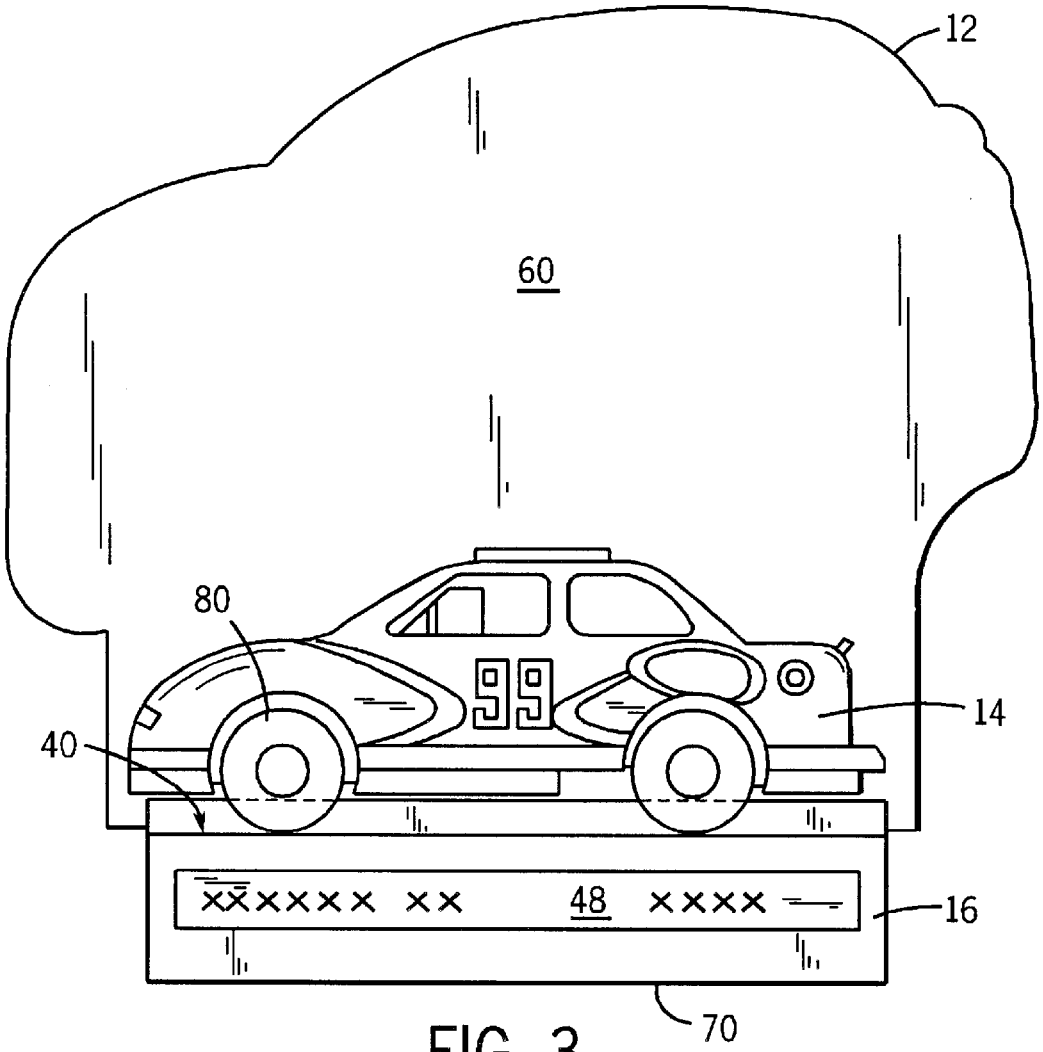
FIG. 3 is a front elevational view of the shaped trading card, the model of a miniature vehicle, and the display stand of FIG. 1.

In accordance with one feature of this invention, FIG. 2 shows a trading card 12 having a front 60 and rear 62 face in the shape of an entertainment figure and combined with a display stand 16 although the trading card 12 may come separately or as an unitary part of the sheet 22. The trading card 12 may be cut by a variety of methods including, but not limited to a die, a scissors, a knife, heat, and light. As shown in FIG. 2, the trading card 12 can display information, text, graphics or pictorials on the front 60 and rear 62 faces relating to the entertainment figure shown. The entertainment figure displayed on the front face 60 may be sports related but may also be related to the movie industry, television, nonfictional celebrity persons, and hobby machines. FIG. 1 shows a preformed transparent plastic shell 20 affixed to the sheet 22. The shell 20 encloses the card 12, and a model 14 resting upon a display stand 16 as described below. In preferred embodiments, the shell 20 has a shape that substantially conforms to the card 12, the stand 16 and the model 14 and is elevated from the sheet 22 by a substantially perpendicular wall 24. However, the shell 20 may be shaped in a variety of forms known in the art.

As most clearly shown in FIG. 2, the display stand 16 includes a planar rear wall 42 that abuts a plastic insert 30, although some embodiments have the planar rear wall 42 abutting the sheet 22. Additionally, it is apparent to one of ordinary skill in the art that the insert 30 could be made from any material that may fill a void. The front edge 70 of the display stand 16 is positioned against the shell 20. In this manner, the display stand 16 can be maintained in a secured horizontal position.

Figure 4:
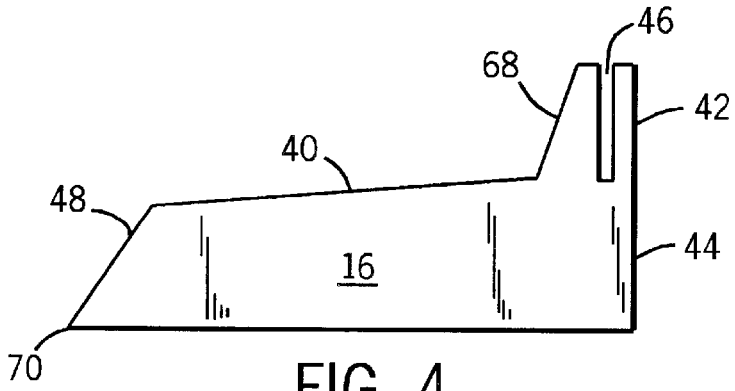
FIG. 4 is a profile view of a display stand of the type which can be used with the present invention.

Furthermore, as shown in FIG. 2 and FIG. 4, the display stand 16 can include a platform surface 40 on the top. In the preferred embodiment, the model 14 is a miniature vehicle with its wheels 80 resting on the platform surface 40, however, it is apparent to one of ordinary skill in the art that any model 14 could be used. While the model 14 and the display stand 16 are in the package 10 shown in FIG. 1, a plastic model support 18 engages the shell 20, the model 14 and the front face 60 of the card 12. The support 18 can pressure the model 14 against the shell 22 and can fill the void between the card 12 and the model 14 to maintain the model 14 in a fixed horizontal and vertical position.

Additionally, FIG. 2 and FIG. 4 show that the display stand 16 can have a rearwardly canting front wall 48 that may display information as described below. Extending upwardly from the platform surface 40 at the rear wall 44 can be pair of planar integral tabs 42 which rear surfaces are substantially coplanar with the rear wall 44 of the display stand 16. An upstanding planar member 68 extends upwardly from the platform surface 40 a short distance forwardly of the tabs 42 to define a pair of aligned slots 46 for receiving the bottom of the trading card 64. The slots 46 have an unstressed width which is slightly less than the thickness of the trading card 12. Therefore, the card 12 is held firmly in place when the card 12 is pushed down into the slots 46. It is apparent to one of ordinary skill in the art that the card 12 may be held firmly in place by other mechanisms such as but not limited to an integrated slot at the rear portion of the platform surface 40 where the slot runs the width of the stand and has a series of projections which hold the card firmly in place.

The model 14 can include information, text, graphics or pictorials that are substantially related to the trading card 12 in the shape of an entertainment figure. Furthermore, the display stand 16 can include information, text, graphics or pictorials that are substantially related to the trading card 12 in the shape of an entertainment figure. As previously discussed, these related objects form a collectable combination.

Accordingly, the present invention also provides a secure attractive packaging system for displaying a combination of a model 14 and a trading card 12 in the shape of an entertainment figure. In the most preferred embodiments of the present invention, the packaging system 10 allows the combination to be displayed in an orientation for optimal visual impact, and provides for a method of using a trading card and its placement to enhance the three-dimensional appearance of the package combination and/or display.

While the present invention has been described in terms of only several of numerous available embodiments, it will be understood by those of ordinary skill in the art that many changes may be made without departing from the true spirit and scope of the invention. Therefore, it is intended by the claims set forth below to cover all such changes and modifications which come within the true spirit and scope of this invention.

I claim:

1. A package system comprising:

a. at least one model;

b. a non-rectangular card, said card in the shape of an entertainment figure; and c. a package for retaining said model and said card, said package including a substantially rigid sheet and a shell, said shell enclosing said card and said model, and said shell adjoining said sheet.

2. The package system as defined in claim 1, wherein said card displays information relating to said entertainment figure.

3. The package system as defined in claim 1, wherein said shell has a shape substantially similar to said card.

4. The package system as defined in claim 1 further comprising an insert, said insert being interspaced between said sheet and said card, said insert restraining the contents of said shell.

5. The package system as defined in claim 1, wherein said model and said card bear substantially matching graphics or pictorials or text.

6. The package system as defined in claim 1 further comprising at least one model support to position said model within said package.

7. The package system as defined in claim 1, wherein at least one said model is a miniature vehicle.

8. A package system comprising:

a. at least one model;

b. a non-rectangular card, said non-rectangular card in the shape of an entertainment figure;

c. a display stand; and d. a package for retaining said model and said non-rectangular card and said stand, said package including a substantially rigid sheet and a shell coupled with said sheet, said shell enclosing said non-rectangular card and said model and said stand.

9. A package system as defined in claim 8, wherein said model is positioned on said stand and said card is coupled with said stand creating a combination enclosed by said shell.

10. The package system as defined in claim 8, wherein said shell is molded in a shape substantially similar to said card, said model, and said stand.

11. The package system as defined in claim 8 further comprising an insert, said insert being interspaced between said sheet and said card or said stand, said insert restraining contents of said shell.

12. The package system as defined in claim 8, wherein said model and said card and said stand bear substantially matching text or graphics or pictorials.

13. The package system as defined in claim 8 further comprising at least one model support, said support restraining said model from movement and being positioned intermediate said model and said card.

14. The package system as defined in claim 8, wherein one said model is a miniature vehicle.

15. A package combination comprising:

a. a model vehicle;

b. a trading card, said card having the shape of a sports related figure, c. a display stand;

d. a package, said package having a substantially rigid sheet and a shell, said shell attached to said package;

e. at least one model support, said support engaging said vehicle and said shell; and f. an insert, said insert separating said sheet from contents of said package.

16. At least one model support as defined in claim 15, wherein said support maintains said model in a fixed position while packaged.

17. An insert as defined in claim 15, wherein said insert engages said card.

18. A method of using a package to present a model and a trading card in a elevated position comprising the steps of:

a. attaching a card to a display stand, said stand having a platform;

b. removably positioning a model atop said platform creating a combination with said stand and card;

c. placing said combination into a shell, said shell molded into a shape substantially similar to said combination;

d. positioning an insert adjacent to the rear of said card; and e. attaching a substantially rigid sheet to said shell enclosing said combination and said insert between said shell and said sheet, said insert elevating said card from said sheet.

19. A method as defined in claim 18, wherein said insert is contiguous and unitary with said sheet.

20. A method as defined in claim 18 further comprising at least one model support elevating said model from said card.

21. A package system comprising:

a. at least one model;

b. a card in the shape of an entertainment figure;

c. at least one model support, said support restraining said model from movement and being positioned intermediate said model and said card;

d. a display stand;

e. a package for retaining said model and said card and said stand and said support, said package including a substantially rigid sheet and a shell coupled with said sheet, said shell enclosing said card and said model and said stand and said support, and said shell being molded in a shape substantially similar to said card, said model, and said stand; and f. an insert, said insert being interspaced between said sheet and said card or said stand, said insert restraining contents of said shell.

* * * * *